US008409373B2

(12) United States Patent
Pandey

(10) Patent No.: US 8,409,373 B2
(45) **Date of Patent: *Apr. 2, 2013**

(54) $L1_2$ ALUMINUM ALLOYS WITH BIMODAL AND TRIMODAL DISTRIBUTION

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 853 days.

This patent is subject to a terminal disclaimer.

(21) Appl. No.: 12/148,395

(22) Filed: Apr. 18, 2008

(65) Prior Publication Data

US 2009/0263274 A1 Oct. 22, 2009

(51) Int. Cl.
*C22C 21/00* (2006.01)

(52) U.S. Cl. ..... 148/439; 148/437; 420/532

(58) Field of Classification Search ..... 148/439, 148/550; 420/532

See application file for complete search history.

(56) References Cited

U.S. PATENT DOCUMENTS

| | | | |
|---|---|---|---|
| 3,619,181 | A | 11/1971 | Willey |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | Le Caer et al. |
| 4,713,216 | A | 12/1987 | Higashi et al. |
| 4,755,221 | A | 7/1988 | Paliwal et al. |
| 4,853,178 | A | 8/1989 | Oslin |

(Continued)

FOREIGN PATENT DOCUMENTS

| | | | |
|---|---|---|---|
| CN | 1436870 | A | 8/2003 |
| CN | 101205578 | A | 6/2008 |

(Continued)

OTHER PUBLICATIONS

BMI. Barkowski Malakoff Inc. The many uses of High Purity Alumina. Technical Specs. http://www.baikowskimalakoff.com/pdf/RC-LS.pdf or http://www.baikowskimalakoff.com/specs.html 2005 (as per MSDS: http://www.baikowskimalakoff.com/pdf/ALUMINA%20-%20BAIKOWSKI%20MALAKOFF.pdf).*

(Continued)

*Primary Examiner* — Jie Yang
(74) *Attorney, Agent, or Firm* — Kinney & Lange, P.A.

(57) ABSTRACT

A two or three phase aluminum alloy having high strength, modulus, ductility and toughness, comprising a fine grain matrix phase nano $L1_2$ alloy having a particle size ranging from about 20 nm to 5 microns and a more ductile larger aluminum alloy coarse grain phase having a particle size ranging from about 25 to 250 microns. The fine grain matrix phase alloy comprises aluminum, at least one of scandium, erbium, thulium, ytterbium, and lutetium; and at least one of gadolinium, yttrium, zirconium, titanium, hafnium, and niobium. The alloy may also include ceramic reinforcements in addition to the fine grain matrix phase and the coarse grain phase.

13 Claims, 5 Drawing Sheets

U.S. PATENT DOCUMENTS

| | | | | |
|---|---|---|---|---|
| 4,865,806 | A | 9/1989 | Skibo et al. | |
| 4,874,440 | A | 10/1989 | Sawtell et al. | |
| 4,915,605 | A | 4/1990 | Chan et al. | |
| 4,927,470 | A | 5/1990 | Cho | |
| 4,933,140 | A | 6/1990 | Oslin | |
| 4,946,517 | A | 8/1990 | Cho | |
| 4,964,927 | A | 10/1990 | Shiflet et al. | |
| 4,988,464 | A | 1/1991 | Riley | |
| 5,032,352 | A | 7/1991 | Meeks et al. | |
| 5,053,084 | A | 10/1991 | Masumoto et al. | |
| 5,055,257 | A * | 10/1991 | Chakrabarti et al. | 148/564 |
| 5,059,390 | A | 10/1991 | Burleigh et al. | |
| 5,066,342 | A | 11/1991 | Rioja et al. | |
| 5,076,340 | A | 12/1991 | Bruski et al. | |
| 5,076,865 | A | 12/1991 | Hashimoto et al. | |
| 5,130,209 | A | 7/1992 | Das et al. | |
| 5,133,931 | A | 7/1992 | Cho | |
| 5,198,045 | A | 3/1993 | Cho et al. | |
| 5,211,910 | A | 5/1993 | Pickens et al. | |
| 5,226,983 | A | 7/1993 | Skinner et al. | |
| 5,256,215 | A | 10/1993 | Horimura | |
| 5,308,410 | A | 5/1994 | Horimura et al. | |
| 5,312,494 | A | 5/1994 | Horimura et al. | |
| 5,318,641 | A | 6/1994 | Masumoto et al. | |
| 5,397,403 | A | 3/1995 | Horimura et al. | |
| 5,458,700 | A | 10/1995 | Masumoto et al. | |
| 5,462,712 | A | 10/1995 | Langan et al. | |
| 5,480,470 | A | 1/1996 | Miller et al. | |
| 5,597,529 | A | 1/1997 | Tack | |
| 5,620,652 | A | 4/1997 | Tack et al. | |
| 5,624,632 | A | 4/1997 | Baumann et al. | |
| 5,882,449 | A | 3/1999 | Waldron et al. | |
| 6,139,653 | A | 10/2000 | Fernandes et al. | |
| 6,149,737 | A | 11/2000 | Hattori et al. | |
| 6,248,453 | B1 | 6/2001 | Watson | |
| 6,254,704 | B1 | 7/2001 | Laul et al. | |
| 6,258,318 | B1 | 7/2001 | Lenczowski et al. | |
| 6,309,594 | B1 | 10/2001 | Meeks, III et al. | |
| 6,312,643 | B1 | 11/2001 | Upadhya et al. | |
| 6,315,948 | B1 | 11/2001 | Lenczowski et al. | |
| 6,331,218 | B1 | 12/2001 | Inoue et al. | |
| 6,355,209 | B1 | 3/2002 | Dilmore et al. | |
| 6,368,427 | B1 | 4/2002 | Sigworth | |
| 6,506,503 | B1 | 1/2003 | Mergen et al. | |
| 6,517,954 | B1 | 2/2003 | Mergen et al. | |
| 6,524,410 | B1 | 2/2003 | Kramer et al. | |
| 6,531,004 | B1 | 3/2003 | Lenczowski et al. | |
| 6,562,154 | B1 | 5/2003 | Rioja et al. | |
| 6,630,008 | B1 | 10/2003 | Meeks, III et al. | |
| 6,702,982 | B1 | 3/2004 | Chin et al. | |
| 6,902,699 | B2 | 6/2005 | Fritzemeier et al. | |
| 6,918,970 | B2 | 7/2005 | Lee et al. | |
| 6,974,510 | B2 | 12/2005 | Watson | |
| 7,048,815 | B2 | 5/2006 | Senkov et al. | |
| 7,097,807 | B1 | 8/2006 | Meeks, III et al. | |
| 7,241,328 | B2 | 7/2007 | Keener | |
| 7,344,675 | B2 | 3/2008 | Van Daam et al. | |
| 2001/0054247 | A1 | 12/2001 | Stall et al. | |
| 2003/0192627 | A1 | 10/2003 | Lee et al. | |
| 2004/0046402 | A1 | 3/2004 | Winardi | |
| 2004/0055671 | A1 | 3/2004 | Olson et al. | |
| 2004/0089382 | A1 | 5/2004 | Senkov et al. | |
| 2004/0170522 | A1 | 9/2004 | Watson | |
| 2004/0191111 | A1 | 9/2004 | Nie et al. | |
| 2005/0147520 | A1 | 7/2005 | Canzona | |
| 2006/0011272 | A1 | 1/2006 | Lin et al. | |
| 2006/0093512 | A1 | 5/2006 | Pandey | |
| 2006/0172073 | A1 * | 8/2006 | Groza et al. | 427/421.1 |
| 2006/0269437 | A1 | 11/2006 | Pandey | |
| 2007/0048167 | A1 | 3/2007 | Yano | |
| 2007/0062669 | A1 | 3/2007 | Song et al. | |
| 2008/0066833 | A1 | 3/2008 | Lin et al. | |

FOREIGN PATENT DOCUMENTS

| | | | |
|---|---|---|---|
| EP | 0208631 | A1 | 6/1986 |
| EP | 0584596 | A2 | 3/1994 |
| EP | 1111079 | A1 | 6/2001 |
| EP | 1249303 | A1 | 10/2002 |
| EP | 1170394 | B1 | 4/2004 |
| EP | 1 439 239 | | 7/2004 |
| EP | 1471157 | A1 | 10/2004 |
| EP | 1 111 078 | | 9/2006 |
| EP | 1 728 881 | | 12/2006 |
| EP | 1 788 102 | | 5/2007 |
| FR | 2656629 | A1 | 12/1990 |
| FR | 2843754 | A1 | 2/2004 |
| JP | 04218638 | A | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2007188878 | A | 7/2007 |
| RU | 2001144 | C1 | 10/1993 |
| RU | 2001145 | C1 | 10/1993 |
| WO | 9002620 | A1 | 3/1990 |
| WO | 9110755 | A2 | 7/1991 |
| WO | 9111540 | A1 | 8/1991 |
| WO | 9532074 | A2 | 11/1995 |
| WO | WO 96/10099 | | 4/1996 |
| WO | 9833947 | A1 | 8/1998 |
| WO | 0037696 | A1 | 6/2000 |
| WO | 0229139 | A2 | 4/2002 |
| WO | 03052154 | A1 | 6/2003 |
| WO | 03085145 | A2 | 10/2003 |
| WO | 03085146 | A1 | 10/2003 |
| WO | 03/104505 | | 12/2003 |
| WO | 2004005562 | A2 | 1/2004 |
| WO | 2004046402 | A2 | 6/2004 |
| WO | 2005045080 | A1 | 5/2005 |
| WO | 2005047554 | A1 | 5/2005 |

OTHER PUBLICATIONS

NPL-1: Microstructure of Al3 Sc with ternary transitional metal additions, Materials Science and Engineering A329-331 (2002) pp. 686-695.*

NPL-2: Hardness conversion table down load from http://www.gordonengland.co.uk/hardness/hardness_conversion_2m.htm.*

European Search Report—EP 09251013.0-2122—Dated Jul. 28, 2009—Seven(7) pages.

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.

Riddle, Y.W., et al. "Improving Recrystallization Resistance in Wrought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Unal, A. et al. "Gas Atomization" from the section "Production of Aluminum and Aluminum-Alloy Powder" ASM Handbook, vol. 7. 2002.

Riddle, Y.W. et al. "A Study of Coarsening, Recyrstallization, and Morphology of Microstructure in Al-Sc-(Zr)-(Mg) Alloys." Metallurgical and Materials Transations A. vol. 35A, Jan. 2004. pp. 341-350.

Mil'Man, Y.V. et al. "Effect of Addiitional Alloying with Transition Metals on the Structure of an Al-7.1 Zn-1.3 Mg-9.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.
Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.
Rachek, O.P. "X-ray diffraction study of amorphous alloys Al-Ni-Ce-Sc with using Ehrenfest's formula." Journal of Non-Crystalline Solids 352 (2006) pp. 3781-3786.
Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008, pp. 3-12.
Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.
Riddle, Y.W., et al. "Recrystallization Performance of AA7050 Varied with Sc and Zr." Material Science Forum. 2000. pp. 799-804.
Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.
Cook, R., et al. "Aluminum and Aluminum Alloy Powders for P/M Applications." The Aluminum Powder Company Limited, Ceracon Inc.

* cited by examiner

$L1_2$ ALUMINUM ALLOYS WITH BIMODAL AND TRIMODAL DISTRIBUTION

CROSS-REFERENCE TO RELATED APPLICATIONS

This application is related to the following co-pending applications that are filed on even date herewith and are assigned to the same assignee: DISPERSION STRENGTHENED $L1_2$ ALUMINUM ALLOYS, Ser. No. 12/148,432; HEAT TREATABLE $L1_2$ ALUMINUM ALLOYS, Ser. No. 12/148,383; HIGH STRENGTH $L1_2$ ALUMINUM ALLOYS, Ser. No. 12/148,394; HIGH STRENGTH $L1_2$ ALUMINUM ALLOYS, Ser. No. 12/148,382; HEAT TREATABLE $L1_2$ ALUMINUM ALLOYS, Ser. No. 12/148,396; HIGH STRENGTH $L1_2$ ALUMINUM ALLOYS, Ser. No. 12/148,387; HIGH STRENGTH ALUMINUM ALLOYS WITH $L1_2$ PRECIPITATES, Ser. No. 12/148,426; HIGH STRENGTH $L1_2$ALUMINUM ALLOYS, Ser. No. 12/148,459; and $L1_2$ STRENGTHENED AMORPHOUS ALUMINUM ALLOYS, Ser. No. 12/148,458.

BACKGROUND

The present invention relates generally to aluminum alloys and more specifically to two and three phase $L1_2$ aluminum alloys with high strength and improved ductility.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and Lu. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). U.S. Patent Application Publication No. 2006/0269437 A1 discloses a high strength aluminum alloy that contains scandium and other elements that is strengthened by $L1_2$ dispersoids.

$L1_2$ strengthened aluminum alloys have high strength and improved fatigue properties compared to commercial aluminum alloys. Fine grain size results in improved mechanical properties of materials. Hall-Petch strengthening has been known for decades where strength increases as grain size decreases. An optimum grain size for optimum strength is in the nano range of about 30 to 100 nm. These alloys also have lower ductility.

Fine grain aluminum alloys exhibit high strength but the lower ductility leads to lower fracture toughness. It would be desirable to develop a high strength aluminum alloy with acceptable fracture toughness.

SUMMARY

The present invention is aluminum alloys with high strength and acceptable fracture toughness. In embodiments, these properties are achieved with a dual phase microstructure. The microstructure consists of a fine grain matrix strengthened by a dispersion of coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. The balance is substantially aluminum containing at least one alloying element selected from silicon, magnesium, lithium, copper, zinc, and nickel.

The addition of larger ductile aluminum alloy second phase particles (i.e., coarse grains) dispersed throughout the high strength fine grain matrix act to increase the fracture toughness by acting to blunt crack tips, thereby reducing the driving force for crack growth. The size of the coarse grains ranges from about 25 to about 250 microns, more preferably about 50 to about 200 microns, and even more preferably about 100 to about 150 microns. To provide a balanced combination of strength, ductility and toughness, the volume fraction of the coarse grains ranges from about 10 to about 50 volume percent, more preferably about 15 to about 40 volume percent, and even more preferably about 20 to about 30 volume percent. The resulting aluminum alloy is a bimodal system alloy.

It has also been discovered that ceramic reinforcements may be added to the bimodal system alloys to further increase their strength and modulus, thereby forming a trimodal system alloy. Trimodal system alloys have a higher load transfer mechanism that results in higher strength and modulus. Aluminum oxide, silicon carbide, boron carbide, aluminum nitride, titanium boride, titanium diboride and titanium carbide are suitable ceramic reinforcements.

In order to be effective, the reinforcing ceramic particles need to have fine size, moderate volume fraction and a good interface between the matrix and reinforcement. These ceramic reinforcements can have particle sizes ranging from about 0.5 to about 50 microns, more preferably about 1 to about 20 microns, and even more preferably 1 to about 10 microns. The volume fraction of ceramic reinforcements that may be added ranges from about 5 to about 40 volume percent, more preferably about 10 to about 30 volume percent, and even more preferably about 15 to about 25 volume percent. These fine ceramic reinforcement particles located at the grain boundary and within the grain boundary will restrict the dislocation from going around particles. The dislocations become attached with particles on the departure side, and thus require more energy to detach the dislocation.

DETAILED DESCRIPTION

Figure 1:
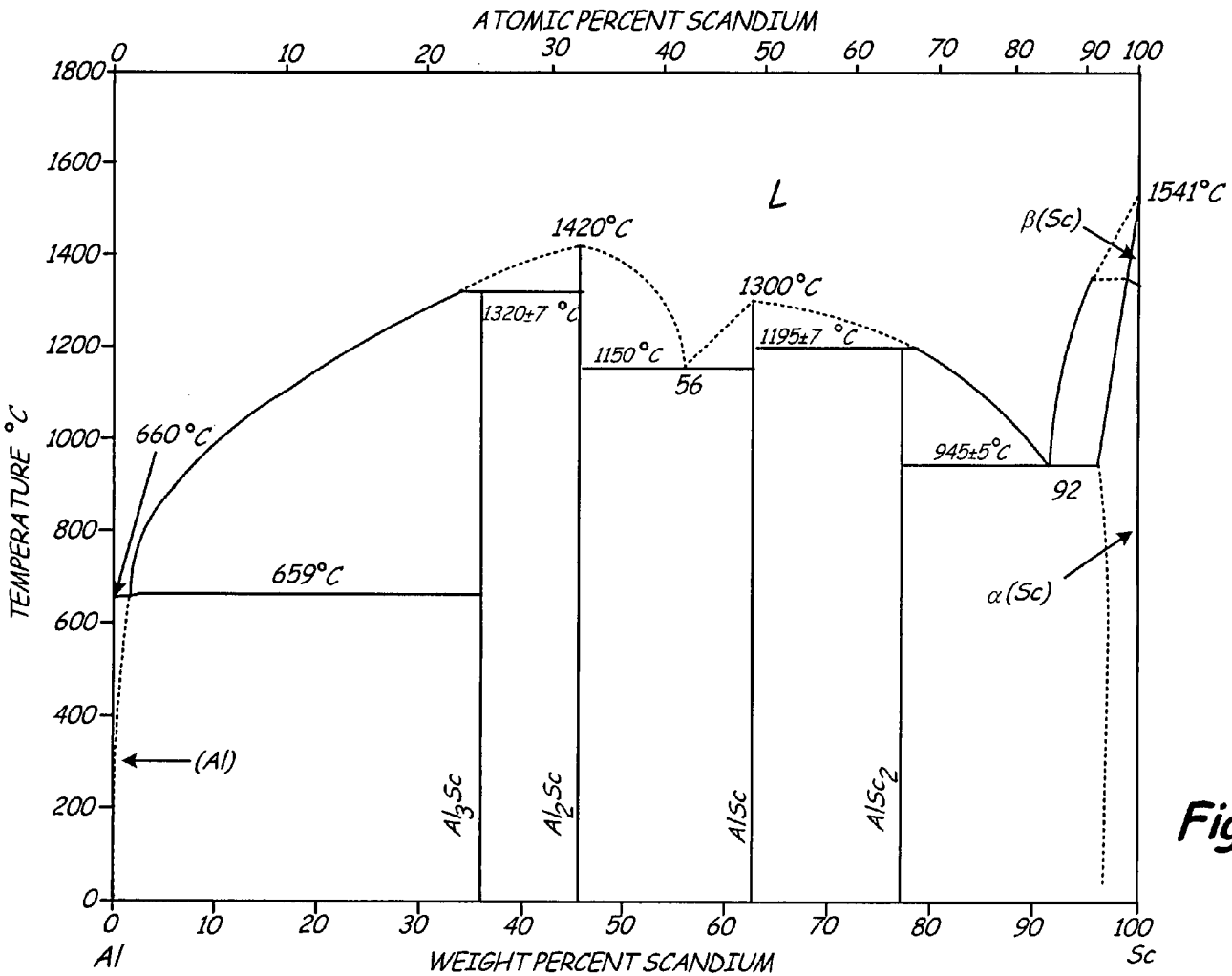
FIG. 1 is an aluminum scandium phase diagram.

The alloys of this invention are based on aluminum based alloys with a bimodal or trimodal microstructure with high strength and fracture toughness for applications at temperatures from about −420° F. (−251° C.) up to about 650° F. (343° C.). A bimodal microstructure consists of relatively coarse ductile grains in a high strength ultra fine grain aluminum alloy matrix strengthened with coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. A trimodal microstructure is created when ceramic reinforcements are added to the bimodal system alloy.

The coarse grains can comprise any aluminum alloy with sufficient strength and ductility.

The high strength fine grain matrix of this invention comprises a solid solution of aluminum and at least one element selected from silicon, magnesium, lithium, copper, zinc, and nickel strengthened by $L1_2$ coherent precipitates where X is at least one first element selected from scandium, erbium, thulium, ytterbium, and lutetium, and at least one second element selected from gadolinium, yttrium, zirconium, titanium, hafnium, and niobium.

The aluminum silicon system is a simple eutectic alloy system with a eutectic reaction at 12.5 weight percent silicon and 1077° F. (577° C.). There is little solubility of silicon in aluminum at temperatures up to 930° F. (500° C.) and none of aluminum in silicon. However, the solubility can be extended significantly by utilizing rapid solidification techniques.

The binary aluminum magnesium system is a simple eutectic at 36 weight percent magnesium and 842° F. (450° C.). There is complete solubility of magnesium and aluminum in the rapidly solidified inventive alloys discussed herein.

The binary aluminum lithium system is a simple eutectic at 8 weight percent lithium and 1105° (596° C.). The equilibrium solubility of 4 weight percent lithium can be extended significantly by rapid solidification techniques. There is complete solubility of lithium in the rapid solidified inventive alloys discussed herein.

The binary aluminum copper system is a simple eutectic at 32 weight percent copper and 1018° F. (548° C.). There is complete solubility of copper in the rapidly solidified inventive alloys discussed herein.

The aluminum zinc binary system is a eutectic alloy system involving a monotectoid reaction and a miscibility gap in the solid state. There is a eutectic reaction at 94 weight percent zinc and 718° F. (381° C.). Zinc has maximum solid solubility of 83.1 weight percent in aluminum at 717.8° F. (381° C.) which can be extended by rapid solidification processes. Decomposition of the super saturated solid solution of zinc in aluminum gives rise to spherical and ellipsoidal GP zones which are coherent with the matrix and act to strengthen the alloy.

The aluminum nickel binary system is a simple eutectic at 5.7 weight percent nickel and 1183.8° F. (639.9° C.). There is little solubility of nickel in aluminum. However, the solubility can be extended significantly by utilizing rapid solidification processes. The equilibrium phase in the aluminum nickel eutectic system is $L1_2$ intermetallic $Al_3Ni$.

In the inventive aluminum based alloys disclosed herein, scandium, erbium, thulium, ytterbium, and lutetium are potent strengtheners that have low diffusivity and low solubility in aluminum. All these elements form equilibrium $Al_3X$ intermetallic dispersoids where X is at least one of scandium, erbium, thulium, ytterbium, and lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Sc$ to coarsening. Additions of zinc, copper, lithium, silicon, and nickel provide solid solution and precipitation strengthening in the aluminum alloys. In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Er$ to coarsening. Additions of zinc, copper, lithium, silicon, and nickel provide solid solution and precipitation strengthening in the aluminum alloys. In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Tm$ to coarsening. Additions of zinc, copper, lithium, silicon, and nickel provide solid solution and precipitation strengthening in the aluminum alloys. In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 mm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Yb$ to coarsening. Additions of zinc, copper, lithium, silicon, and nickel provide solid solution and precipitation strengthening in the aluminum alloys. In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Lu$ to coarsening. Additions of zinc, copper, lithium, silicon, and nickel provide solid solution and precipitation strengthening in the aluminum alloys. In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

Exemplary aluminum alloys for the bimodal system alloys of this invention include, but are not limited to (in weight percent unless otherwise specified):

about Al-M-(10-50 vol. %)CG-(0.1-4)Sc-(0.1-20)Gd;
about Al-M-(10-50 vol. %)CG-(0.1-20)Er-(0.1-20)Gd;
about Al-M-(10-50 vol. %)CG-(0.1-15)Tm-(0.1-20)Gd;
about Al-M-(10-50 vol. %)CG-(0.1-25)Yb-(0.1-20)Gd;
about Al-M-(10-50 vol. %)CG-(0.1-25)Lu-(0.1-20)Gd;
about Al-M-(10-50 vol. %)CG-(0.1-4)Sc-(0.1-20)Y;
about Al-M-(10-50 vol. %)CG-(0.1-20)Er-(0.1-20)Y;
about Al-M-(10-50 vol. %)CG-(0.1-15)Tm-(0.1-20)Y;
about Al-M-(10-50 vol. %)CG-(0.1-25)Yb-(0.1-20)Y;
about Al-M-(10-50 vol. %)CG-(0.1-25)Lu-(0.1-20)Y;
about Al-M-(10-50 vol. %)CG-(0.1-4)Sc-(0.05-4)Zr;
about Al-M-(10-50 vol. %)CG-(0.1-20)Er-(0.05-4)Zr;
about Al-M-(10-50 vol. %)CG-(0.1-15)Tm-(0.05-4)Zr;
about Al-M-(10-50 vol. %)CG-(0.1-25)Yb-(0.05-4)Zr;
about Al-M-(10-50 vol. %)CG-(0.1-25)Lu-(0.05-4)Zr;
about Al-M-(10-50 vol. %)CG-(0.1-4)Sc-(0.05-10)Ti;
about Al-M-(10-50 vol. %)CG-(0.1-20)Er-(0.05-10)Ti;
about Al-M-(10-50 vol. %)CG-(0.1-15)Tm-(0.05-10)Ti;
about Al-M-(10-50 vol. %)CG-(0.1-25)Yb-(0.05-10)Ti;
about Al-M-(10-50 vol. %)CG-(0.1-25)Lu-(0.05-10)Ti;
about Al-M-(10-50 vol. %)CG-(0.1-4)Sc-(0.05-10)Hf;
about Al-M-(10-50 vol. %)CG-(0.1-20)Er-(0.05-10)Hf;
about Al-M-(10-50 vol. %)CG-(0.1-15)Tm-(0.05-10)Hf;

about Al-M-(10-50 vol. %)CG-(0.1-25)Yb-(0.05-10)Hf;

about Al-M-(10-50 vol. %)CG-(0.1-25)Lu-(0.05-10)Hf;

about Al-M-(10-50 vol. %)CG-(0.1-4)Sc-(0.05-5)Nb;

about Al-M-(10-50 vol. %)CG-(0.1-20)Er-(0.05-5)Nb;

about Al-M-(10-50 vol. %)CG-(0.1-15)Tm-(0.05-5)Nb;

about Al-M-(10-50 vol. %)CG-(0.1-25)Yb-(0.05-5)Nb; and about Al-M-(10-50 vol. %)CG-(0.1-25)Lu-(0.05-5)Nb.

M is at least one of about (4-25) weight percent silicon, (1-8) weight percent magnesium, (0.5-3) weight percent lithium, (0.2-3) weight percent copper, (3-12) weight percent zinc, and (1-12) weight percent nickel. CG is a coarse grain ductile aluminum alloy having a particle size of about 25 to about 250 microns.

The amount of silicon present in the fine grain matrix of this invention if any may vary from about 4 to about 25 weight percent, more preferably from about 4 to about 18 weight percent, and even more preferably from about 5 to about 11 weight percent.

The amount of magnesium present in the fine grain matrix of this invention if any may vary from about 1 to about 8 weight percent, more preferably from about 3 to about 7.5 weight percent, and even more preferably from about 4 to about 6.5 weight percent.

The amount of lithium present in the fine grain matrix of this invention if any may vary from about 0.5 to about 3 weight percent, more preferably from about 1 to about 2.5 weight percent, and even more preferably from about 1 to about 2 weight percent.

The amount of copper present in the fine grain matrix of this invention if any may vary from about 0.2 to about 3 weight percent, more preferably from about 0.5 to about 2.5 weight percent, and even more preferably from about 1 to about 2.5 weight percent.

The amount of zinc present in the fine grain matrix of this invention if any may vary from about 3 to about 12 weight percent, more preferably from about 4 to about 10 weight percent, and even more preferably from about 5 to about 9 weight percent.

The amount of nickel present in the fine grain matrix of this invention if any may vary from about 1 to about 12 weight percent, more preferably from about 2 to about 10 weight percent, and even more preferably from about 4 to about 10 weight percent.

The amount of scandium present in the fine grain matrix of this invention if any may vary from 0.1 to about 4 weight percent, more preferably from about 0.1 to about 3 weight percent, and even more preferably from about 0.2 to about 2.5 weight percent. The Al—Sc phase diagram shown in FIG. 1 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second.

Figure 2:
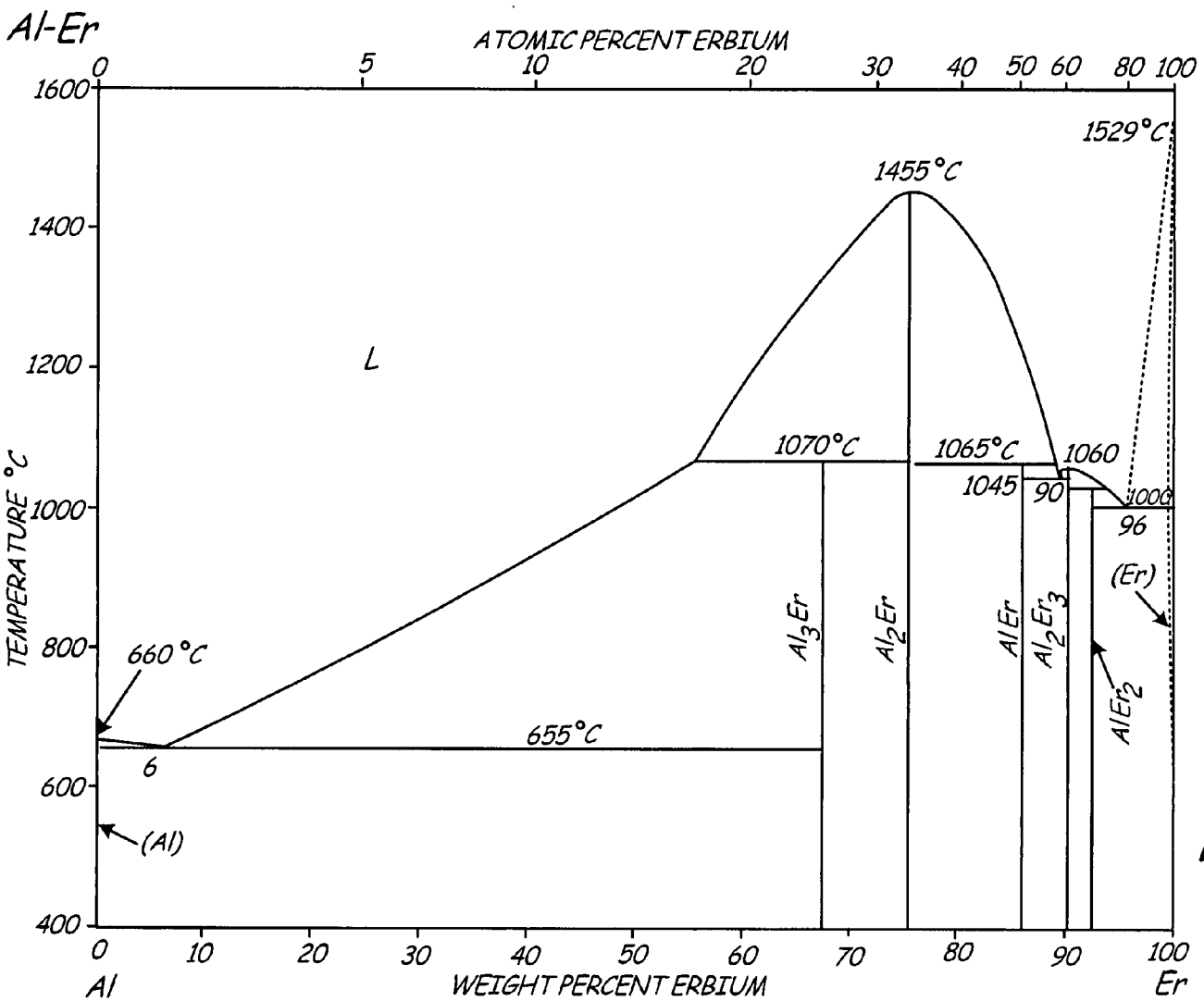
FIG. 2 is an aluminum erbium phase diagram.

The amount of erbium present in the fine grain matrix of this invention, if any, may vary from about 0.1 to about 20 weight percent, more preferably from about 0.3 to about 15 weight percent, and even more preferably from about 0.5 to about 10 weight percent. The Al—Er phase diagram shown in FIG. 2 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second.

Figure 3:
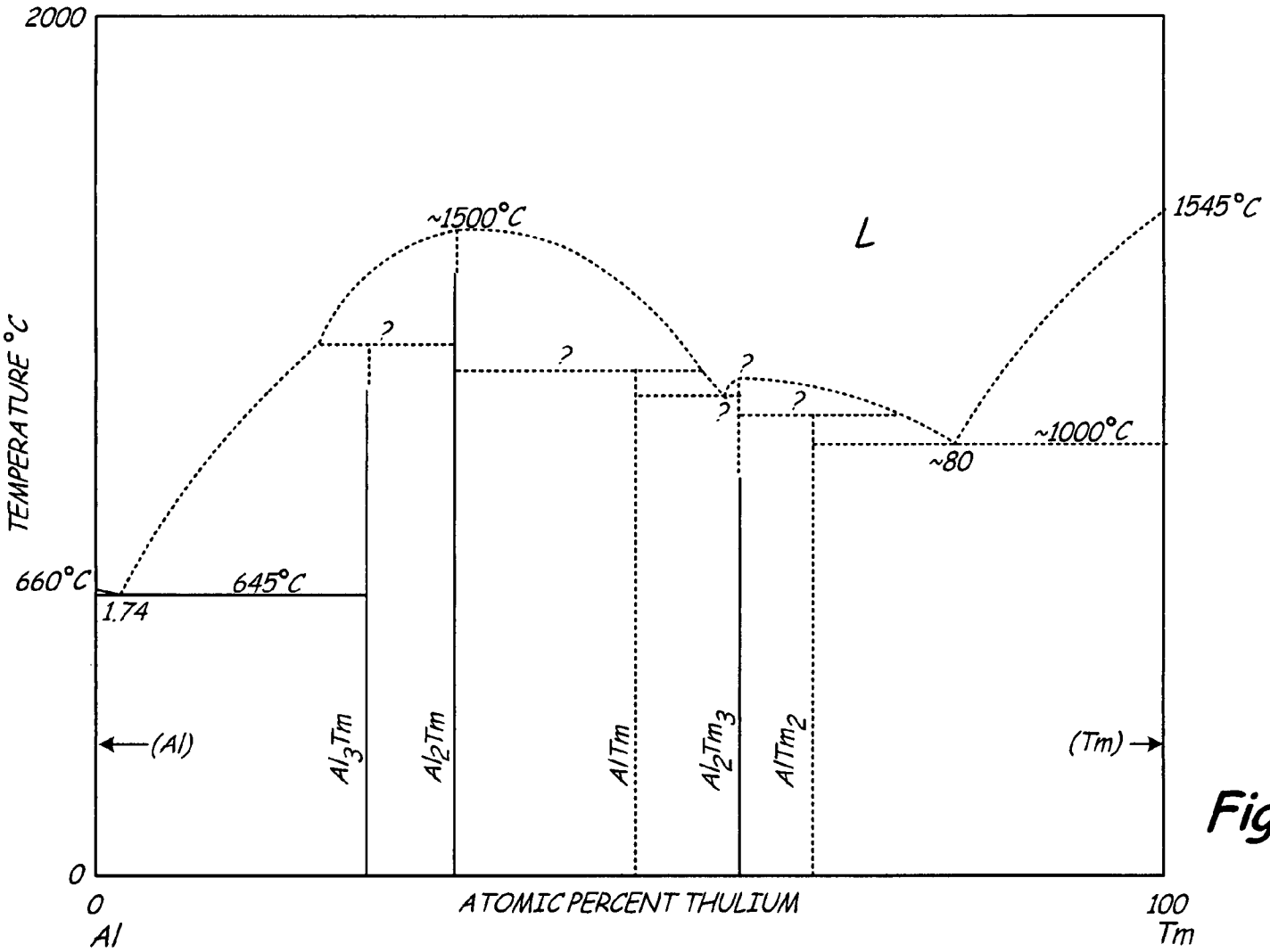
FIG. 3 is an aluminum thulium phase diagram.

The amount of thulium present in the alloys of this invention, if any, may vary from about 0.1 to about 15 weight percent, more preferably from about 0.2 to about 10 weight percent, and even more preferably from about 0.4 to about 6 weight percent. The Al—Tm phase diagram shown in FIG. 3 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 4:
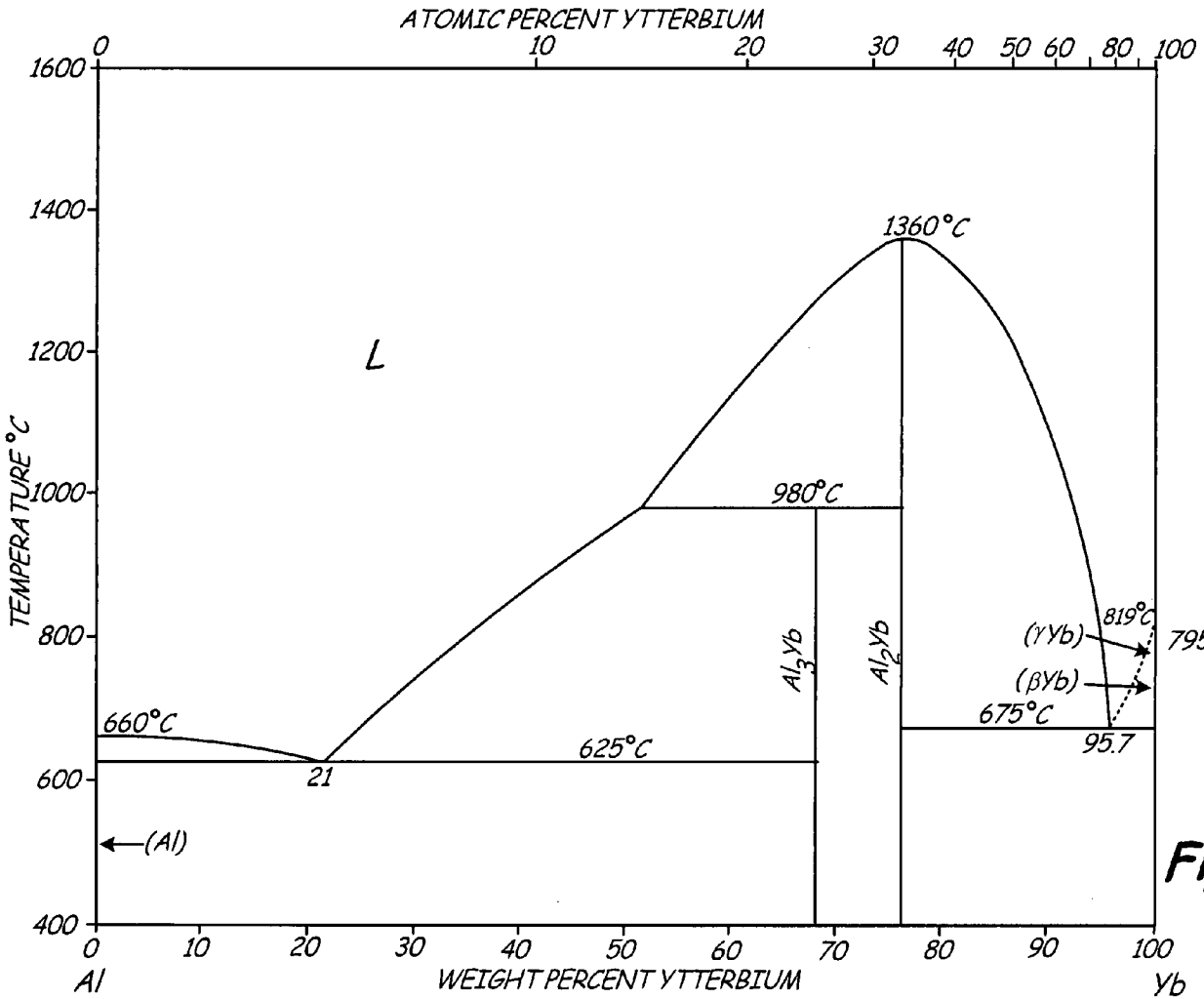
FIG. 4 is an aluminum ytterbium phase diagram.

The amount of ytterbium present in the alloys of this invention, if any, may vary from about 0.1 to about 25 weight percent, more preferably from about 0.3 to about 20 weight percent, and even more preferably from about 0.4 to about 10 weight percent. The Al—Yb phase diagram shown in FIG. 4 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C. per second.

Figure 5:
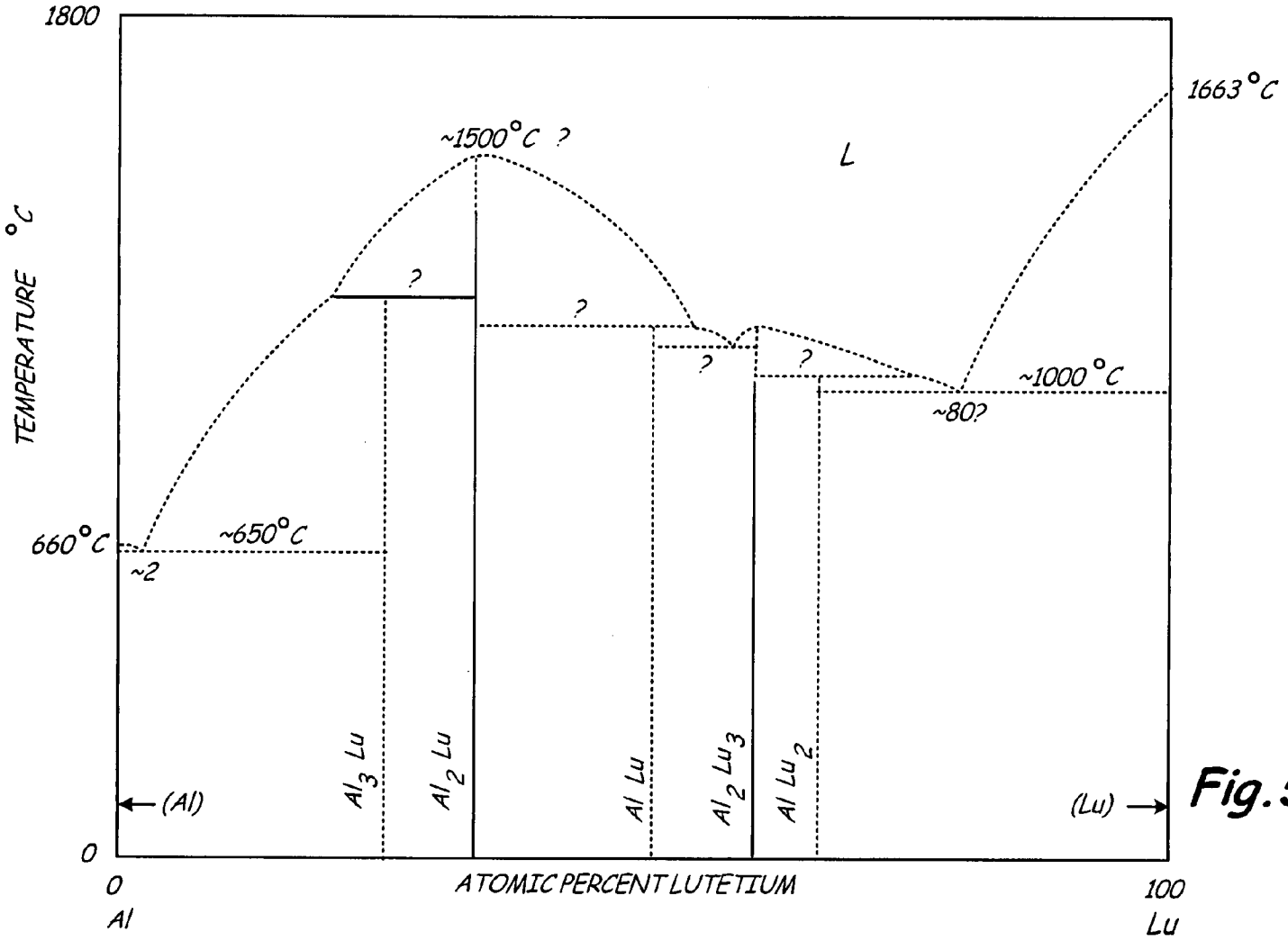
FIG. 5 is an aluminum lutetium phase diagram.

The amount of lutetium present in the alloys of this invention, if any, may vary from about 0.1 to about 25 weight percent, more preferably from about 0.3 to about 20 weight percent, and even more preferably from about 0.4 to about 10 weight percent. The Al—Lu phase diagram shown in FIG. 5 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second. The amount of gadolinium present in the alloys of this invention, if any, may vary from about 0.1 to about 20 weight percent, more preferably from about 0.3 to about 15 weight percent, and even more preferably from about 0.5 to about 10 weight percent.

The amount of gadolinium present in the alloys of this invention, if any, may vary from about 0.1 to about 20 weight percent, more preferably from about 0.3 to about 15 weight percent, and even more preferably from about 0.5 to about 10 weight percent.

The amount of yttrium present in the alloys of this invention, if any, may vary from about 0.1 to about 20 weight percent, more preferably from about 0.3 to about 15 weight percent, and even more preferably from about 0.5 to about 10 weight percent.

The amount of zirconium present in the alloys of this invention, if any, may vary from about 0.05 to about 4 weight percent, more preferably from about 0.1 to about 3 weight percent, and even more preferably from about 0.3 to about 2 weight percent.

The amount of titanium present in the alloys of this invention, if any, may vary from about 0.05 to about 10 weight percent, more preferably from about 0.2 to about 8 weight percent, and even more preferably from about 0.4 to about 4 weight percent.

The amount of hafnium present in the alloys of this invention, if any, may vary from about 0.05 to about 10 weight percent, more preferably from about 0.2 to about 8 weight percent, and even more preferably from about 0.4 to about 5 weight percent.

The amount of niobium present in the alloys of this invention, if any, may vary from about 0.05 to about 5 weight percent, more preferably from about 0.1 to about 3 weight percent, and even more preferably from about 0.2 to about 2 weight percent.

In order to have the best properties for the fine grain matrix of this invention, it is desirable to limit the amount of other elements. Specific elements that should be reduced or eliminated include no more than about 0.1 weight percent iron, 0.1 weight percent chromium, 0.1 weight percent manganese, 0.1 weight percent vanadium, and 0.1 weight percent cobalt. The total quantity of additional elements should not exceed about 1% by weight, including the above listed impurities and other elements.

More preferred exemplary aluminum alloys of the bimodal system alloys of this invention include, but are not limited to (in weight percent unless otherwise specified):

about Al-M-(15-40 vol. %)CG-(0.1-3)Sc-(0.3-15)Gd;
about Al-M-(15-40 vol. %)CG-(0.3-15)Er-(0.3-15)Gd;
about Al-M-(15-40 vol. %)CG-(0.2-10)Tm-(0.3-15)Gd;
about Al-M-(15-40 vol. %)CG-(0.3-20)Yb-(0.3-15)Gd;
about Al-M-(15-40 vol. %)CG-(0.3-20)Lu-(0.3-15)Gd;
about Al-M-(15-40 vol. %)CG-(0.1-3)Sc-(0.3-15)Y;
about Al-M-(15-40 vol. %)CG-(0.3-15)Er-(0.3-15)Y;
about Al-M-(15-40 vol. %)CG-(0.2-10)Tm-(0.3-15)Y;
about Al-M-(15-40 vol. %)CG-(0.3-20)Yb-(0.3-15)Y;
about Al-M-(15-40 vol. %)CG-(0.3-20)Lu-(0.3-15)Y;
about Al-M-(15-40 vol. %)CG-(0.1-3)Sc-(0.1-3)Zr;
about Al-M-(15-40 vol. %)CG-(0.3-15)Er-(0.1-3)Zr;
about Al-M-(15-40 vol. %)CG-(0.2-10)Tm-(0.1-3)Zr;
about Al-M-(15-40 vol. %)CG-(0.3-20)Yb-(0.1-3)Zr;
about Al-M-(15-40 vol. %)CG-(0.3-20)Lu-(0.1-3)Zr;
about Al-M-(15-40 vol. %)CG-(0.1-3)Sc-(0.2-8)Ti;
about Al-M-(15-40 vol. %)CG-(0.3-15)Er-(0.2-8)Ti;
about Al-M-(15-40 vol. %)CG-(0.2-10)Tm-(0.2-8)Ti;
about Al-M-(15-40 vol. %)CG-(0.3-20)Yb-(0.2-8)Ti;
about Al-M-(15-40 vol. %)CG-(0.3-20)Lu-(0.2-8)Ti;
about Al-M-(15-40 vol. %)CG-(0.1-3)Sc-(0.2-8)Hf;
about Al-M-(15-40 vol. %)CG-(0.3-15)Er-(0.2-8)Hf;
about Al-M-(15-40 vol. %)CG-(0.2-10)Tm-(0.2-8)Hf;
about Al-M-(15-40 vol. %)CG-(0.3-20)Yb-(0.2-8)Hf;
about Al-M-(15-40 vol. %)CG-(0.3-20)Lu-(0.2-8)Hf;
about Al-M-(15-40 vol. %)CG-(0.1-3)Sc-(0.1-3)Nb;
about Al-M-(15-40 vol. %)CG-(0.3-15)Er-(0.1-3)Nb;
about Al-M-(15-40 vol. %)CG-(0.2-10)Tm-(0.1-3)Nb;
about Al-M-(15-40 vol. %)CG-(0.3-20)Yb-(0.1-3)Nb; and
about Al-M-(15-40 vol. %)CG-(0.3-20)Lu-(0.1-3)Nb.

M is at least one of about (4-18) weight percent silicon, (3-7.5) weight percent magnesium, (1-2.5) weight percent lithium, (0.5-2.5) weight percent copper, (4-10) weight percent zinc, and (2-10) weight percent nickel. CG is a coarse grain ductile aluminum alloy having a particle size of about 50 to about 200 microns.

Even more preferred exemplary aluminum alloys of the bimodal system alloys of this invention include, but are not limited to (in weight percent unless otherwise specified):

about Al-M-(20-30 vol. %)CG-(0.2-2.5)Sc-(0.5-10)Gd;
about Al-M-(20-30 vol. %)CG-(0.5-10)Er-(0.5-10)Gd;
about Al-M-(20-30 vol. %)CG-(0.4-6)Tm-(0.5-10)Gd;
about Al-M-(20-30 vol. %)CG-(0.4-10)Yb-(0.5-10)Gd;
about Al-M-(20-30 vol. %)CG-(0.4-10)Lu-(0.5-10)Gd;
about Al-M-(20-30 vol. %)CG-(0.2-2.5)Sc-(0.5-10)Y;
about Al-M-(20-30 vol. %)CG-(0.5-10)Er-(0.5-10)Y;
about Al-M-(20-30 vol. %)CG-(0.4-6)Tm-(0.5-10)Y;
about Al-M-(20-30 vol. %)CG-(0.4-10)Yb-(0.5-10)Y;
about Al-M-(20-30 vol. %)CG-(0.4-10)Lu-(0.5-10)Y;
about Al-M-(20-30 vol. %)CG-(0.2-2.5)Sc-(0.3-2)Zr;
about Al-M-(20-30 vol. %)CG-(0.5-10)Er-(0.3-2)Zr;
about Al-M-(20-30 vol. %)CG-(0.4-6)Tm-(0.3-2)Zr;
about Al-M-(20-30 vol. %)CG-(0.4-10)Yb-(0.3-2)Zr;
about Al-M-(20-30 vol. %)CG-(0.4-10)Lu-(0.3-2)Zr;
about Al-M-(20-30 vol. %)CG-(0.2-25)Sc-(0.4-5)Ti;
about Al-M-(20-30 vol. %)CG-(0.5-10)Er-(0.4-5)Ti;
about Al-M-(20-30 vol. %)CG-(0.4-6)Tm-(0.4-5)Ti;
about Al-M-(20-30 vol. %)CG-(0.4-10)Yb-(0.4-5)Ti;
about Al-M-(20-30 vol. %)CG-(0.4-10)Lu-(0.4-5)Ti;
about Al-M-(20-30 vol. %)CG-(0.2-2.5)Sc-(0.4-5)Hf;
about Al-M-(20-30 vol. %)CG-(0.5-10)Er-(0.4-5)Hf;
about Al-M-(20-30 vol. %)CG-(0.4-6)Tm-(0.4-5)Hf;
about Al-M-(20-30 vol. %)CG-(0.4-10)Yb-(0.4-5)Hf;
about Al-M-(20-30 vol. %)CG-(0.4-10)Lu-(0.4-5)Hf;
about Al-M-(20-30 vol. %)CG-(0.2-2.5)Sc-(0.2-2)Nb;
about Al-M-(20-30 vol. %)CG-(0.5-10)Er-(0.2-2)Nb;
about Al-M-(20-30 vol. %)CG-(0.4-6)Tm-(0.2-2)Nb;
about Al-M-(20-30 vol. %)CG-(0.4-10)Yb-(0.2-2)Nb; and
about Al-M-(20-30 vol. %)CG-(0.4-10)Lu-(0.2-2)Nb.

M is at least one of about (5-11) weight percent silicon, (4-6.5) weight percent magnesium, (1-2) weight percent lithium, (1-2.5) weight percent copper, (5-9) weight percent zinc, and (4-10) weight percent nickel. CG is a coarse grain ductile aluminum alloy having a particle size of about 100 to 150 microns.

Exemplary aluminum alloys of the trimodal system alloys of this invention include, but are not limited to (in weight percent unless otherwise specified):

about Al-M-(10-50 vol. %)CG-(0.1-4)Sc-(0.1-20)Gd-(5-40 vol. %)$Al_2O_3$;
about Al-M-(10-50 vol. %)CG-(0.1-20)Er-(0.1-20)Gd-(5-40 vol. %)$Al_2O_3$;
about Al-M-(10-50 vol. %)CG-(0.1-15)Tm-(0.1-20)Gd-(5-40 vol. %)$Al_2O_3$;
about Al-M-(10-50 vol. %)CG-(0.1-25)Yb-(0.1-20)Gd-(5-40 vol. %)$Al_2O_3$;
about Al-M-(10-50 vol. %)CG-(0.1-25)Lu-(0.1-20)Gd-(5-40 vol. %) $Al_2O_3$;
about Al-M-(10-50 vol. %)CG-(0.1-4)Sc-(0.1-20)Y-(5-40 vol. %)$B_4C$;
about Al-M-(10-50 vol. %)CG-(0.1-20)Er-(0.1-20)Y-(5-40 vol. %)$B_4C$;
about Al-M-(10-50 vol. %)CG-(0.1-15)Tm-(0.1-20)Y-(5-40 vol. %)$B_4C$;
about Al-M-(10-50 vol. %)CG-(0.1-25)Yb-(0.1-20)Y-(5-40 vol. %)$B_4C$
about Al-M-(10-50 vol. %)CG-(0.1-25)Lu-(0.1-20)Y-(5-40 vol. %)$B_4C$;
about Al-M-(10-50 vol. %)CG-(0.1-4)Sc-(0.05-3.0)Zr-(5-40 vol. %)SiC;

about Al-M-(10-50 vol. %)CG-(0.1-20)Er-(0.05-4.0)Zr-(5-40 vol. %)SiC;

about Al-M-(10-50 vol. %)CG-(0.1-15)Tm-(0.05-4.0)Zr-(5-40 vol. %)SiC;

about Al-M-(10-50 vol. %)CG-(0.1-25)Yb-(0.05-4.0)Zr-(5-40 vol. %)SiC;

about Al-M-(10-50 vol. %)CG-(0.1-25)Lu-(0.05-4.0)Zr-(5-40 vol. %)SiC;

about Al-M-(10-50 vol. %)CG-(0.1-4)Sc-(0.05-10)Ti-(5-40 vol. %)$TiB_2$;

about Al-M-(10-50 vol. %)CG-(0.1-20)Er-(0.05-10)Ti-(5-40 vol. %)$TiB_2$;

about Al-M-(10-50 vol. %)CG-(0.1-15)Tm-(0.05-10)Ti-(5-40 vol. %)$TiB_2$;

about Al-M-(10-50 vol. %)CG-(0.1-25)Yb-(0.05-10)Ti-(5-40 vol. %)$TiB_2$;

about Al-M-(10-50 vol. %)CG-(0.1-25)Lu-(0.05-10)Ti-(5-40 vol. %)$TiB_2$;

about Al-M-(10-50 vol. %)CG-(0.1-4)Sc-(0.05-10)Hf-(5-40 vol. %)TiB;

about Al-M-(10-50 vol. %)CG-(0.1-20)Er-(0.05-10)Hf-(5-40 vol. %)TiB;

about Al-M-(10-50 vol. %)CG-(0.1-15)Tm-(0.05-10)Hf-(5-40 vol. %)TiB;

about Al-M-(10-50 vol. %)CG-(0.1-25)Yb-(0.05-10)Hf-(5-40 vol. %)TiB;

about Al-M-(10-50 vol. %)CG-(0.1-25)Lu-(0.05-10)Hf-(5-40 vol. %)TiB;

about Al-M-(10-50 vol. %)CG-(0.1-4)Sc-(0.05-5)Nb-(5-40 vol. %)TiC;

about Al-M-(10-50 vol. %)CG-(0.1-20)Er-(0.05-5)Nb-(5-40 vol. %)TiC;

about Al-M-(10-50 vol. %)CG-(0.1-15)Tm-(0.05-5)Nb-(5-40 vol. %)TiC;

about Al-M-(10-50 vol. %)CG-(0.1-25)Yb-(0.05-5)Nb-(5-40 vol. %)TiC; and about Al-M-(10-50 vol. %)CG-(0.1-25)Lu-(0.05-5)Nb-(5-40 vol. %)TiC.

M is at least one of about (4-25) silicon, (1-8) magnesium, (0.5-3) lithium, (0.2-3) copper, (3-12) zinc, and (1-12) nickel. CG is a coarse grain ductile aluminum alloy having a particle size of about 25 to about 250 microns.

The ceramic reinforcements added to create these trimodal system alloys provide additional strength and modulus enhancements which depend on particle size and volume fraction of the ceramic reinforcements.

These $L1_2$ bimodal and trimodal alloys may be made using standard powder metallurgy processing wherein the fine rapidly solidified matrix powder is mixed with the coarse ductile phase powder in an inert environment to prevent oxidation. The powder mix is then degassed and compacted in any suitable manner such as, for example, by vacuum hot pressing or blind die compaction (where compaction occurs in both by shear deformation) or by vacuum hot pressing (where compaction occurs by diffusion or creep). The fine grain matrix powder can be made by any rapid solidification technique that can provide elemental supersaturation such as, but not limited to, melt spinning, splat quenching, spray deposition, vacuum plasma spraying, cold spraying, laser melting, mechanical alloying, ball milling (i.e. at room temperature), cryomilling (i.e. in a liquid nitrogen environment), laser deposition, or atomization. Any processing technique utilizing cooling rates equivalent to or higher than about $10^{3\circ}$ C./second is considered to be a rapid solidification technique for these alloys. Therefore, the minimum desired cooling rate for the processing of these alloys is about $10^{3\circ}$ C./second, although higher cooling rates may be necessary for the fine grain matrix alloys having larger amounts of alloying additions.

Although the present invention has been described with reference to preferred embodiments, workers skilled in the art will recognize that changes may be made in form and detail without departing from the spirit and scope of the invention.

The invention claimed is:

1. An aluminum alloy with at least a bimodal microstructure comprising large grains in a fine grained matrix wherein:

the large grains comprise any aluminum alloy having a grain size ranging from about 25 to about 250 microns; and the fine grain matrix having a grain size ranging from about 20 nm to about 5 microns comprises an aluminum alloy strengthened with $L1_2$ $Al_3X$ dispersoids wherein X comprises at least one first element selected from scandium, erbium, thulium, ytterbium, and lutetium, and at least one second element selected from gadolinium, yttrium, zirconium, titanium, hafnium, and niobium.

2. The aluminum alloy of claim 1, wherein the fine grain matrix comprises a solid solution of aluminum and at least one element selected from silicon, magnesium, lithium, copper, zinc, and nickel.

3. The aluminum alloy of claim 2, wherein the fine grain matrix comprises at least one of about 4 to about 25 weight percent silicon, about 1 to about 8 weight percent magnesium, about 0.5 to about 3 weight percent lithium, about 0.2 to about 3 weight percent copper, about 3 to about 12 weight percent zinc, about 1 to about 12 weight percent nickel.

4. The aluminum alloy of claim 1 with at least a trimodal microstructure, further comprising at least one ceramic reinforcement selected from aluminum oxide, silicon carbide, boron carbide, aluminum nitride, titanium boride, titanium diboride and titanium carbide.

5. The aluminum alloy of claim 4, wherein the ceramic reinforcement particle size ranges from about 0.5 to about 50 microns.

6. The aluminum alloy of claim 4, wherein the ceramic reinforcements comprise about 5 to about 40 volume percent of the alloy.

7. The aluminum alloy of claim 1, wherein the alloy is fabricated using powder metallurgical techniques.

8. The aluminum alloy of claim 7, wherein the fine grain matrix is produced by a rapid solidification technique utilizing a cooling rate of at least about $10^{3\circ}$ C./second, and a casting process.

9. The aluminum alloy of claim 7, wherein the rapid solidification technique comprises at least one of: melt spinning, splat quenching, atomization, spray deposition, vacuum plasma spraying, cold spraying, laser melting, mechanical alloying, cryomilling, spin forming and ball milling.

10. The aluminum alloy of claim 7, wherein the casting process comprises at least one of: squeeze casting, die casting, sand casting, and permanent mold casting.

11. The aluminum alloy of claim 1, wherein the large grains comprise about 10 to about 50 volume percent of the alloy.

12. The aluminum alloy of claim 1, wherein the $Al_3X$ dispersoids comprise:

at least one first element selected from the group consisting of about 0.1 to about 4 weight percent scandium, about 0.1 to about 20 weight percent erbium, about 0.1 to about 15 weight percent thulium, about 0.1 to about 25 weight percent ytterbium, and about 0.1 to about 25 weight percent lutetium; and at least one second element selected from the group consisting of about 0.1 to about 20 weight percent gadolinium, about 0.1 to about 20 weight percent yttrium, about 0.05 to about 4 weight percent zirconium, about 0.05 to about 10 weight percent titanium, about 0.05 to about 10 weight percent hafnium, and about 0.05 to about 5 weight percent niobium.

13. The aluminum alloy of claim 1, wherein the alloy is capable of being used at temperatures from about −420° F. (−251° C.) up to about 650° F. (343° C.).

* * * * *

UNITED STATES PATENT AND TRADEMARK OFFICE

CERTIFICATE OF CORRECTION

PATENT NO. : 8,409,373 B2
APPLICATION NO. : 12/148395
DATED : April 2, 2013
INVENTOR(S) : Pandey It is certified that error appears in the above-identified patent and that said Letters Patent is hereby corrected as shown below:

In the Specification

Col. 4, Line 64
Delete "mm"
Insert --nm--

Signed and Sealed this
Third Day of February, 2015

Michelle K. Lee

Michelle K. Lee
*Deputy Director of the United States Patent and Trademark Office*